US009593574B2

(12) United States Patent
AlGouhi

(10) Patent No.: US 9,593,574 B2
(45) Date of Patent: Mar. 14, 2017

(54) WELL COMPLETION SLIDING SLEEVE VALVE BASED SAMPLING SYSTEM AND METHOD

(71) Applicant: Saudi Arabian Oil Company, Dhahran (SA)

(72) Inventor: AlWaleed Abdullah AlGouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 182 days.

(21) Appl. No.: 14/212,226

(22) Filed: Mar. 14, 2014

(65) Prior Publication Data

US 2015/0260038 A1 Sep. 17, 2015

(51) Int. Cl.

| | |
|---|---|
| ***E21B 34/14*** | (2006.01) |
| ***E21B 49/08*** | (2006.01) |
| ***E21B 33/124*** | (2006.01) |
| ***E21B 49/10*** | (2006.01) |
| *E21B 34/00* | (2006.01) |

(52) U.S. Cl.

CPC ..... *E21B 49/08* (2013.01); *E21B 33/124* (2013.01); *E21B 34/14* (2013.01); *E21B 49/081* (2013.01); *E21B 49/083* (2013.01); *E21B 49/084* (2013.01); *E21B 49/10* (2013.01); *E21B 2034/007* (2013.01)

(58) Field of Classification Search

CPC ..... E21B 34/14; E21B 49/083; E21B 49/081; E21B 2034/007; E21B 49/088; E21B 49/08; E21B 49/082; E21B 49/10

See application file for complete search history.

(56) References Cited

U.S. PATENT DOCUMENTS

| | | | | | |
|---|---|---|---|---|---|
| 2,915,123 | A | * | 12/1959 | Lebourg | 166/63 |
| 3,111,169 | A | * | 11/1963 | Hyde | 166/145 |
| 3,323,360 | A | | 6/1967 | Nutter | |
| 3,327,781 | A | * | 6/1967 | Nutter | 166/264 |
| 3,384,170 | A | | 5/1968 | Van Poollen | |
| 4,252,195 | A | * | 2/1981 | Fredd | E21B 33/12 166/113 |

(Continued)

OTHER PUBLICATIONS

PCT International Search Report and the Written Opinion; dated Jul. 8, 2015; International Application No. PCT/US2015/019902; International File Date: Mar. 11, 2015.

*Primary Examiner* — Kipp Wallace

(74) *Attorney, Agent, or Firm* — Bracewell LLP; Constance Gall Rhebergen

(57) ABSTRACT

A well completion system includes tubing, and packers that seal the annulus of the well outside the tubing. The packers are spaced to define voids in the annulus that are substantially free from hydrostatic pressure. Also included are hollow sleeve valves having upper and lower sealing elements, and that have closed and open positions. Each sleeve valve is positioned within the tubing at a depth corresponding to a void in the annulus. Ports extend through the sleeve valve and tubing, so that when the sleeve valve is closed, the port is closed, and when the sleeve valve is open, the port is open. Also included is a sampling tool having top and bottom sealing elements, the bottom sealing element for engaging the lower sealing element of a sleeve valve, and the top sealing element for engaging the upper sealing element of the sleeve valve when the sleeve valve is open.

10 Claims, 3 Drawing Sheets

(56) References Cited

U.S. PATENT DOCUMENTS

| | | | | |
|---|---|---|---|---|
| 5,137,086 | A | 8/1992 | Stokley et al. | |
| 5,375,659 | A * | 12/1994 | Gilbert et al. | 166/264 |
| 5,540,280 | A | 7/1996 | Schultz et al. | |
| 6,918,440 | B2 | 7/2005 | Garcia-Soule et al. | |
| 7,278,480 | B2 | 10/2007 | Longfield et al. | |
| 7,832,472 | B2 | 11/2010 | Themig | |
| 8,342,239 | B2 | 1/2013 | Kutac | |
| 2009/0014168 | A1* | 1/2009 | Tips et al. | 166/73 |
| 2009/0288833 | A1* | 11/2009 | Graham et al. | 166/306 |
| 2010/0170682 | A1 | 7/2010 | Brennan, III et al. | |
| 2010/0200291 | A1 | 8/2010 | Patel et al. | |
| 2012/0024050 | A1 | 2/2012 | Godager | |
| 2013/0068451 | A1 | 3/2013 | Getzlaf et al. | |
| 2013/0168099 | A1* | 7/2013 | Themig | 166/308.1 |

* cited by examiner

WELL COMPLETION SLIDING SLEEVE VALVE BASED SAMPLING SYSTEM AND METHOD

BACKGROUND OF THE INVENTION

1. Field of the Invention

The present technology relates to oil and gas production. In particular, the present technology relates to 2. Description of the Related Art Fluid sampling is commonly conducted in reservoirs to test reservoir fluid. In mature wells, for example, the chemical and physical parameters of fluid within a reservoir can change over time, and sampling and testing of the fluid can help to optimize recovery strategies from the wells. Examples of reservoir properties that can be analyzed include density, formation volume factor, viscosity, interfacial tension, gas/oil ratio, and/or compressibility.

The sampling and testing of downhole fluid properties, however, presents engineers with a number of technical challenges. For example, engineers must select the correct zone for sampling, connect to a reservoir, minimize contamination of the samples, obtain sufficient amounts of samples to be tested, and transport samples to the surface and laboratory facilities. To address such challenges, different techniques for sampling and testing reservoir fluids have been developed.

For example, in a well that penetrates a staked reservoir, fluid samples can be taken before the well is cased and cemented. At this early stage, taking samples from the well is simplified by the fact that drilling mud in the well provides hydrostatic pressure on the borehole wall to prevent the uncontrolled production of reservoir fluids. A tool having a pair of packers can be lowered into the well to a desired location, and the packers can expand to isolate a portion of the well between the packers from the hydrostatic pressure of the drilling mud. With the packers in place, samples from the reservoir can be withdrawn from the formation, after which the tool and samples are drawn to the surface. Later, the well can be cased and cemented, and may be used an a cased hole observation well during the production life of the reservoir. This technique of testing reservoir fluid is disadvantageous, however, because it is limited to the period of time before a well is cased and cemented.

Another technique for sampling and testing reservoir fluids is to utilize a tool that penetrates the casing of an already-cased well. Tools for carrying out this technique can be lowered into the cased well, and can perforate the casing at a desired location to access the formation and withdraw samples. Such a technique is problematic, however, because casing integrity must be restored after perforation, which can be a difficult, dangerous, and costly endeavor.

SUMMARY OF THE INVENTION

One embodiment of the present technology provides a well completion sampling system, including tubing extending into a well, and a plurality of packers surrounding the tubing and sealing the annulus of the well outside the tubing, the plurality of packers spaced to define voids in the annulus that are substantially free from hydrostatic pressure created by fluids in the well. Also included are a plurality of hollow sleeve valves connected to the tubing and having an upper sealing element and a lower sealing element, and a closed position and an open position. A plurality of ports extend transversely through the tubing, each port positioned adjacent a sleeve valve so that when the sleeve valve is closed, the port is closed, and when the sleeve valve is open, the port is open. The well completion sampling system also includes a sampling tool for insertion into the tubing, the sampling tool having top and bottom sealing elements, the bottom sealing element of the sampling tool for sealingly engaging the lower sealing element of a sleeve valve, and the top sealing element for sealingly engaging the upper sealing element of the sleeve valve when the sleeve valve is in the open position.

The well completion sampling system can also include an electronic gauge positioned in the well outside the tubing adjacent the port for measuring properties of fluid in the void of the annulus. In addition, the plurality of sleeve valves can each be connected to the tubing and have a longitudinal through bore, the longitudinal through bore of each sleeve valve having a different diameter than the longitudinal through bores of the other sleeve valves. The sleeve valves are arranged in the well in descending order based on the size of the diameter of each sleeve valves longitudinal through bore, with the sleeve valve having the largest diameter longitudinal through bore nearest the top of the well and that with the smallest diameter longitudinal through bore nearest the bottom of the well.

The well completion sampling system can also include a plurality of sampling tools for insertion into the tubing, each sampling tool having top and bottom sealing elements that correspond in size to the upper and lower sealing elements of a particular sleeve valve, so that when each sampling tool reaches its corresponding sleeve valve, it opens the sleeve valve. In addition, the system can include a probe attached to the sampling tool for extending through a port of a sleeve valve and into contact with the wall of the well. Furthermore, the sampling tool can have a sampling port that can be selectively opened to receive fluid into the sampling tool, or closed to retain fluid within the sampling tool.

Another embodiment of the present technology provides a well completion sampling system, including tubing extending into a well, and a plurality of packers surrounding the tubing and sealing the annulus of the well outside the tubing, the plurality of packers spaced to define voids in the annulus that are substantially free from hydrostatic pressure created by fluids in the well. The system can also include a plurality of hollow sleeve valves connected to the tubing and having an upper sealing element and a lower sealing element, and a closed position and an open position, each sleeve valve positioned within the tubing at a depth corresponding to a void in the annulus. A plurality of ports extend can extend transversely through the tubing, each port positioned adjacent a sleeve valve so that when the sleeve valve is closed, the port is closed, and when the sleeve valve is open, the port is open. Furthermore, the system can include a plurality of sampling tools for insertion into the tubing, each particular sampling tool having top and bottom sealing elements sized to seal against the upper and lower sealing elements of a particular sleeve valve, thereby permitting an operator to selectively open and close individual sleeve valves.

The well completion sampling system can include electronic gauges positioned in the well outside the tubing adjacent the plurality of ports for measuring properties of fluid in an annulus of the well. In addition, the system can include probes attached to the sampling tools for extending through the ports of a sleeve valve and into contact with a wall of the well.

Yet another embodiment of the present technology provides a method of sampling fluid in a well bore. The method includes the steps of providing a plurality of sleeve valves in a tubing in the well bore, the sleeve valves each having an open position that allows fluid access to fluid outside the tubing in the wellbore, and a closed position. The method can further include the step of inserting a sampling tool corresponding in size to one of the plurality of sleeve valves into the wellbore until it contacts the sleeve valve and moves the sleeve valve to an open position. The method further includes the steps of filling the sampling tool with fluid from the well bore by maintaining the sampling tool in the open sleeve valve, removing the sampling tool from the sleeve valve, thereby moving the sleeve valve to the closed position, and transporting the fluid out of the well bore by extracting the sampling tool from the well bore.

The method can also include the step of arranging the plurality of sleeve valves in the well in descending order based on the size of each sleeve valve, with the sleeve valve having the largest size nearest the top of the well, and that with the smallest size nearest the bottom of the well. In addition, the method can include the step of extending a probe through at least one of the sleeve valves and the tubing to collect fluid samples from the wellbore.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE EXEMPLARY EMBODIMENTS

Figure 1:
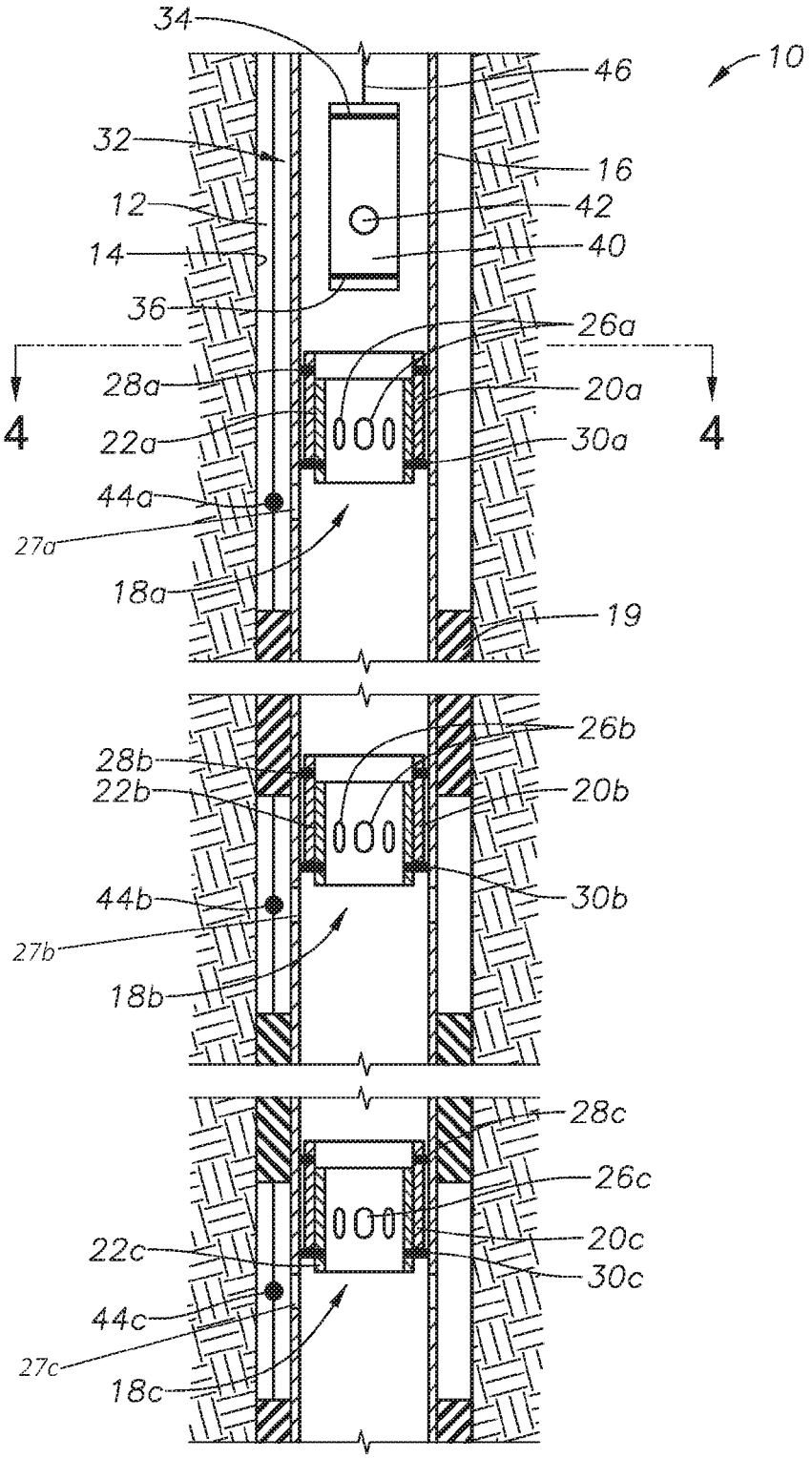
FIG. 1 is side cross-sectional view of a sampling system according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

FIG. 1 is a side view of a sampling system 10 according to an embodiment of the present technology. As shown, the sampling system 10 is positioned in an open hole wellbore 12 having bore walls 14 and tubing 16 extending therethrough. The tubing 16 acts as the functional equivalent of a casing in a well where the sampling system 10 is installed. The tubing 16 includes one or more sleeve valves 18*a-c*, and one more tubing ports 27*a-c* adjacent the one or more sleeve valves. Open-hole packers, or swellable elastomers 19, can be positioned between the tubing 16 and the bore walls 14. The swellable elastomers 19 can substantially form a seal between the tubing 16 and the bore walls 14, thereby isolating predetermined portions of the annulus 24 from hydrostatic pressure in the annulus 24, and otherwise performing a similar function to the cement in a cased well. The swellable elastomers can typically be inserted within the tubing in a contracted condition, and then swell when they contact fluid in the wellbore until they form a seal between the tubing 16 and the bore walls 14.

The sleeve valves 18*a-c* are telescoping in nature, having an outer portion 20*a-c* and an inner portion 22*a-c*. As described in greater detail below, the sleeve valves 18*a-c* have an open position and a closed position. When in the open position, such as the uppermost sleeve valve 18*a* in FIG. 2, the inner portion 22*a* extends downward relative to the outer portion 20*a*. Alternately, when in the closed position, such as all of the valves shown in FIG. 1, the inner portion 22*a* is contained within outer portion 20*a*. In the open position, the inside of the sleeve valve 18*a* is in fluid communication with the annulus 24 outside the tubing 16 via ports 26*a-c*. In the closed position, the inner portion 22*a* of the sleeve valve 18*a* fits inside the outer portion 20*a* adjacent the port 26*a*, thereby blocking the port 26*a* and closing fluid communication between the inside of the sleeve valves 18*a* and the annulus 24. The sleeve valves 18*a-c* also include an upper sealing element 28*a-c*, and a lower sealing element 30*a-c*. Each upper sealing element 28*a-c* can seal against the tubing 16, and prevent fluid from passing between the upper ends of the sleeve valves 18*a-c* and the tubing 16.

The sampling system 10 also includes a sampling tool 32. The sampling tool has a top inflatable sealing element 34 and a bottom inflatable sealing element 36. At least a portion of the sampling tool 32 is hollow, and is capable of receiving fluid through a sampling port 42. The sampling port 42 can be positioned anywhere between the top and bottom inflatable sealing elements 34, 36. Although the top and bottom sealing elements 34, 36 are described herein as being inflatable, and sealing element that has the ability to expand and contract after insertion in a well could be used.

Certain embodiments of the technology can further include pressure/volume/temperature (PVT) gauges 44*a-c* for measuring parameters of the reservoir fluid outside the tubing 16 in the annulus 24. The PVT gauges 44*a-c* can be located in the annulus 24 near the sleeve valves 18*a-c*, and can be connected to equipment at the surface either by a wire 46, or wirelessly, such as through a radio or other type of signal. In some embodiments, the PVT gauges 44*a-c* can be electronic, although other appropriate types of gauges can be used as well. Alternately, a pressure and temperature gauge can be used instead of a PVT gauge. In either case, the wires connecting the gauges to the surface can be run through cuts made in the swellable elastomers 19. As the swellable elastomers 19 swell, they seal around the wire in addition to sealing against the well bore walls.

Figure 2:
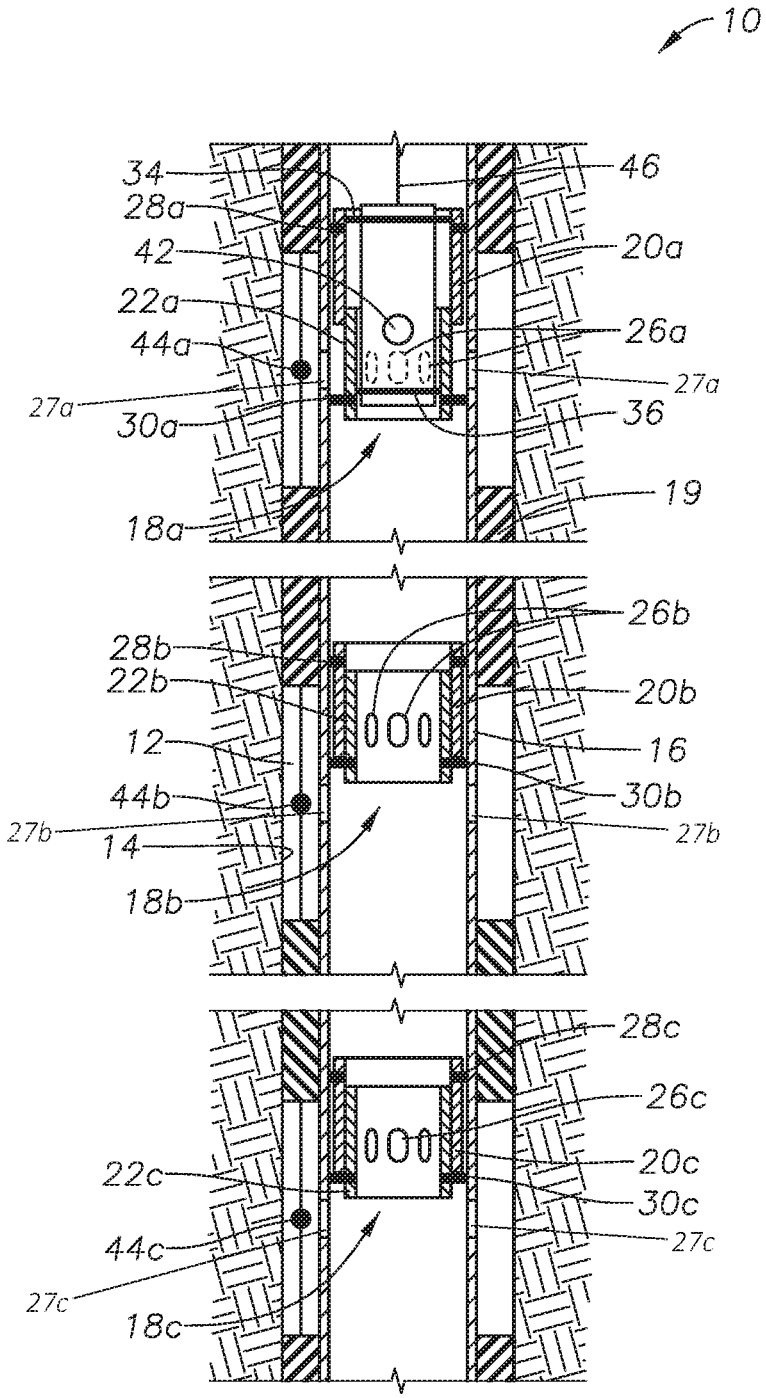
FIG. 2 is a side cross-sectional view of the sampling system of FIG. 1, with the sampling tool engaging a sleeve valve.
Figure 4:
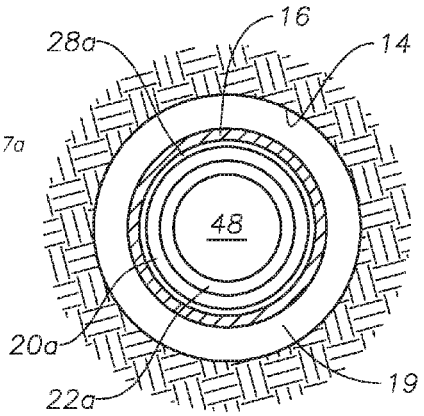
FIG. 4 is a top cross-sectional view of a sleeve valve of the present technology taken along line 4-4 of FIG. 1.

Referring now to FIG. 2, there is shown a sampling tool 32*a* engaging a sleeve valve 18*a* to collect reservoir fluid from the annulus 24. In practice, the sampling tool 32*a* is lowered through the tubing 16 by attaching the sampling tool 32*a* to a wireline 46. Although a wireline 46 is shown, the sampling tool 32*a* could alternately be attached to coiled tubing or any other appropriate device. The sampling tool 32*a* is then lowered into the tubing 16 until it reaches the sleeve valve 18*a*. Upon reaching the sleeve valve 18*a*, a lower portion of the sampling tool 32*a* passes into and through the bore 48*a* (shown in FIG. 4) of the sleeve valve 18*a* until the bottom inflatable sealing element 36*a* reaches the lower sealing element 30*a* of the sleeve valve 18*a*. Next, the bottom inflatable sealing element 36*a* inflates until it contacts the lower sealing element 30*a*, and forms a seal that prevents fluid from entering the bottom of the sleeve valve 18*a* around the bottom inflatable sealing element 36*a*. Thereafter, the sampling tool 32*a* pushes the lower sealing element 30*a* downward, causing the inner portion 22*a* of the sleeve valve 18*a* to telescope downward until the sleeve valve 18*a* is in the open position.

As the valve 18*a* reaches the open position, the top inflatable sealing element 34*a* of the sampling tool 32*a* aligns with the upper sealing element 28*a* of the sleeve valve 18*a*. At this point the top inflatable sealing element 34*a* inflates until it contacts the upper sealing element 28*a* of the sleeve valve 18*a*, and forms a seal that prevents fluid from entering the top of the sleeve valve 18*a* around the top inflatable sealing element 34*a*. Once in the open position, fluid passes from the formation through tubing port 27*a*, and enters the sleeve valve 18*a* through the port 26*a*. Once inside the sleeve valve 18*a*, the fluid then enters the lower portion 40*a* of the sampling tool 32*a* through the sampling port 42*a*.

To remove the sampling tool 32*a* from the sleeve valve 18*a*, the above steps are repeated in reverse order. That is, the top inflatable sealing element is deflated, and the sampling tool 32*a* is lifted upward using the wireline 46. As the sampling tool 32*a* moves upward, the inner portion 22*a* of the sleeve valve 18*a* is pulled by the bottom inflatable sealing element 36*a* upward into the outer portion 20*a* so that the sleeve valve 18*a* closes. In some embodiments, the inner portion 22*a* of the sleeve valve 18*a* can be biased, such as, for example, with a spring (not shown), to assist the inner portion 22*a* as it slides upward into the outer portion 20*a*. After the sleeve valve 18*a* is closed, the bottom inflatable sealing element 36*a* can be deflated, thereby releasing the sampling tool 32*a* from the sleeve valve 18*a*. Thereafter, the sampling tool 32*a* can be pulled to the surface, where the reservoir fluid collected in the sampling tool 32*a* can be analyzed. Additional information about, for example, the pressure, temperature, or other parameters of the reservoir fluid can be obtained by the PVT gauge 44*a* adjacent the sleeve valve 18*a* where the reservoir fluid sample is taken.

Figure 3:
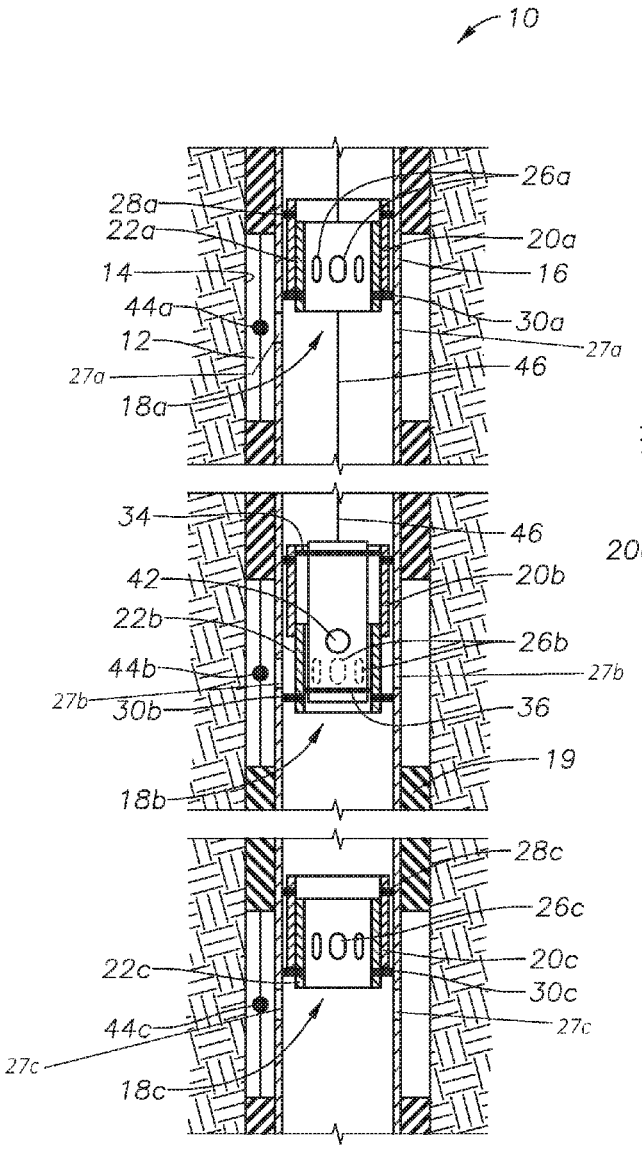
FIG. 3 is a side cross-sectional view of the sampling system of FIGS. 1 and 2, with the sampling tool engaging a different sleeve than that of FIG. 1.

FIG. 3 shows a sampling system 10 having a sampling tool 32*b* that engages a sleeve valve 18*b* to collect a sample of reservoir fluid from a portion of the annulus 24 further downhole from the sleeve valve 18*a*. One difference between sampling tool 32*b* and sampling tool 32*a* of FIG. 2 is that sampling tool 32*b* has a smaller outside diameter. This allows sampling tool 32*b* to pass through the bore 48*a* of sampling tool 18*a* and continue down the tubing until its bottom inflatable sealing element 36*b* aligns with the lower sealing element 30*b* of the sleeve valve 18*b*. The top and bottom inflatable sealing elements 34*b*, 36*b* are sized to engage and seal against the upper and lower sealing elements 28*b*, 30*b* of the sleeve valve 18*b* so that the sampling tool 32*b* can open and close the sleeve valve 18*b*. In alternative embodiments, the sampling tools 32*a*, 32*b* can have the same diameter. In such a system, the sampling tool 32*b* can pass through the sampling tool 18*a* as long as the top and bottom inflatable sealing elements 34*b*, 36*b* are in a deflated condition.

Once the bottom inflatable sealing element 36*b* of the sampling tool 32*b* contacts the lower sealing element 30*b* of the sleeve valve 32*b*, the process of opening the sleeve valve taking a reservoir fluid sample, and closing the sleeve valve 32*b* is similar to that described above in reference to FIG. 2. In particular, the bottom inflatable sealing element 36*b* inflates, and the sampling tool 32*b* pushes the lower sealing element 30*b* downward, causing the inner portion 22*b* of the sleeve valve 18*b* to telescope downward until the sleeve valve 18*b* is in the open position. When the valve 18*b* reaches the open position, the top inflatable sealing element 34*b* inflates and sealingly engages the upper sealing element 28*b* of the sleeve valve 18*b*. Once in the open position, as discussed above, fluid passes from the formation through tubing port 27*b*, and enters the sleeve valve 18*b* through the ports 26*b*. Once inside the sleeve valve 18*b*, the fluid then enters the lower portion 40*b* of the sampling tool 32.*b* through the sampling port 42*b*. The reservoir fluid that enters the sleeve valve 18*b* is prevented from entering the main part of the tubing 16 by the upper and lower sealing elements 28*b*, 30*b*.

To remove the sampling tool 32*b* from the sleeve valve 18*b*, the above steps are repeated in reverse order. That is, the top inflatable sealing element 34*b* deflates, and the sampling tool 32*b* is lifted upward using the wireline 46. As the sampling tool 32*b* moves upward, the inner portion 22*b* of the sleeve valve 18*b* is pulled upward into the outer portion 20*b* so that the sleeve valve 18*b* closes. In some embodiments, the inner portion 22*b* of the sleeve valve 18*b* can be biased, such as, for example, with a spring (not shown), to help the inner portion 22*b* to slide upward into the outer portion 20*b*. After the sleeve valve 18*b* is closed, the top inflatable sealing element 34*b* can be deflated, and the sampling tool 32*b* can be pulled to the surface through the bore 48*a* of sleeve valve 18*a*. At the surface, the reservoir fluid collected in the sampling tool 32*b* can be analyzed. Additional information about, for example, the pressure, temperature, or other parameters of the reservoir fluid can be obtained by the PVT gauge 44*b* adjacent the sleeve valve 18*b* where the reservoir fluid sample is taken.

As shown in FIGS. 2 and 3, additional sleeve valves, such as sleeve valve 18*c*, can be included in the tubing 16. Each sleeve valve 18*a-c* can have a bore 48*a-c* of a different diameter, and the sleeve valves 18*a-c* can be arranged in the well in order of descending bore diameter. The sleeve valve 18*a* having the largest diameter should be located nearest the top of the well, and that with the smallest diameter should be located nearest the bottom of the well. Sampling tools 32*a-c* of different diameters can be provided, and each sampling tool 32*a-c* can corresponding to a sleeve valve 18*a-c*. In use, a particular sampling tool 32*a-c* can pass through the bores 48*a-c* of any number of sleeve valves 18*a-c* until the sleeve valve 18*a-c* corresponding to that particular sampling tool 32*a-c* is found and engaged. In this way, reservoir fluid samples can be collected from multiple depths within the well. Although FIGS. 1-3 show three sleeve valves 18*a-c*, any number of sleeve valves can be used depending on the depth of the well and other factors.

Figure 5:
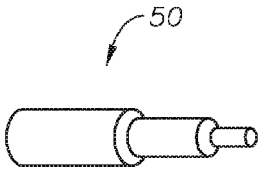
FIG. 5 is a perspective view of a probe according to an embodiment of the present technology.

Referring to FIG. 5, there is shown a probe that can be used with certain embodiments of the present technology. For example, the probe can be attached to a sampling tool 32*a-c*, and positioned so that when the sampling tool 32*a-c* is inserted into a sleeve valve 18*a-c*, and the sleeve valve is open, the probe can extend through at least one of the ports 26*a-c* in the sleeve valve 18*a-c*. In embodiments that include a probe 50, the port(s) 26*a-c* of the sleeve valve 18*a-c* can be sized to allow passage of at least a portion of the probe 50 therethrough. When the valve 18*a-c* is open, the probe 50 can pass through a port 26*a-c* and contact the wall of the well. At the well wall, the probe can collect fluid samples or perform reservoir measurements and tests, such as permeability tests. The probe can also optionally be equipped to bore into the well wall. As shown in FIG. 5, in some embodiments the probe 50 can be a telescoping probe, capable of extending and contracting along its longitudinal axis to reach a well wall of varying distance from the sampling tool 32*a-c*.

One advantage of the sampling system 10 is that is does not require damaging the tubing or a casing by drilling through it to reach the reservoir. Instead, ports 26*a-c* are predisposed in the sleeve valves 18*a-c* and can easily be opened and closed as described above. This allows for repeated and continuous monitoring and sampling of reservoir fluid throughout the life of a well without undue damage to the tubing 16. Although the sampling system 10 of the present technology can be used to collect reservoir samples during any stage of operations, it is useful for sampling well fluid in mature wells that have been in production for a length of time. The sampling system 10 can be used to monitor reservoir conditions over the life of the well, and to track changes in the reservoir that will help to design better recovery methods.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

What is claimed is:

1. A well completion sampling system, comprising:

tubing extending into a well;

a plurality of packers surrounding the tubing and sealing the annulus of the well outside the tubing, the plurality of packers spaced to define voids in the annulus that are substantially free from hydrostatic pressure created by fluids in the well;

a plurality of hollow sleeve valves connected to the tubing and having an upper sealing element and a lower sealing element, and a closed position and an open position, each sleeve valve positioned within the tubing at a depth corresponding to a void in the annulus;

a plurality of ports extending transversely through the tubing, each port positioned adjacent a sleeve valve so that when the sleeve valve is closed, the lower sealing element is above the port, and when the sleeve valve is open, the lower sealing element is below the port; and a sampling tool for insertion into the tubing, the sampling tool having top and bottom sealing elements, the bottom sealing element of the sampling tool for sealingly engaging the lower sealing element of a sleeve valve, and the top sealing element for sealingly engaging the upper sealing element of the sleeve valve when the sleeve valve is in the open position, the engagement of the bottom sealing element of the sampling tool and the lower sealing element of the sleeve valve fixing the position of the bottom sealing element relative to the lower sealing element so that the movement of the sampling tool down the well after such engagement moves the sleeve valve from the closed position to the open position.

2. The well completion sampling system of claim 1, further comprising:

an electronic gauge positioned in the well outside the tubing adjacent the port for measuring properties of fluid in the void of the annulus.

3. The well completion sampling system of claim 1, wherein the plurality of sleeve valves is each connected to the tubing and has a longitudinal through bore, the longitudinal through bore of each sleeve valve having a different diameter than the longitudinal through bores of the other sleeve valves, the sleeve valves arranged in the well in descending order based on the size of the diameter of each sleeve valves longitudinal through bore, with the sleeve valve having the largest diameter longitudinal through bore nearest the top of the well and that with the smallest diameter longitudinal through bore nearest the bottom of the well.

4. The well completion sampling system of claim 3, further comprising:

a plurality of sampling tools for insertion into the tubing, each sampling tool having top and bottom sealing elements that correspond in size to the upper and lower sealing elements of a particular sleeve valve, so that when each sampling tool reaches its corresponding sleeve valve, it opens the sleeve valve.

5. The well completion sampling system of claim 1, wherein the sampling tool has a sampling port that can be selectively opened to receive fluid into the sampling tool, or closed to retain fluid within the sampling tool.

6. The well completion sampling system of claim 1, wherein each of the plurality of sleeve valves spans the entire cross-section of the tubing, so that when the sleeve valve is closed, and the sampling tool is sealingly engaged with a sleeve valve, fluid flow through the tubing past the sleeve valve is prohibited.

7. A well completion sampling system, comprising:

tubing extending into a well;

a plurality of packers surrounding the tubing and sealing the annulus of the well outside the tubing, the plurality of packers spaced to define voids in the annulus that are substantially free from hydrostatic pressure created by fluids in the well;

a plurality of hollow sleeve valves connected to the tubing and having an upper sealing element and a lower sealing element, and a closed position and an open position, each sleeve valve positioned within the tubing at a depth corresponding to a void in the annulus;

a plurality of ports extending transversely through the tubing, each port positioned adjacent a sleeve valve so that when the sleeve valve is closed, the lower sealing element is above the port, and when the sleeve valve is open, the lower sealing element is below the port; and a plurality of sampling tools for insertion into the tubing, each particular sampling tool having top and bottom sealing elements sized to seal against the upper and lower sealing elements of a particular sleeve valve, thereby permitting an operator to selectively open and close individual sleeve valves, the engagement of the bottom sealing element of the sampling tool and the lower sealing element of one of the sleeve valves fixing the position of the bottom sealing element relative to the lower sealing element so that the movement of the sampling tool down the wall after such engagement moves such sleeve valve from the closed position to the open position.

8. The well completion sampling system of claim 7, further comprising:

electronic gauges positioned in the well outside the tubing adjacent the plurality of ports for measuring properties of fluid in an annulus of the well.

9. A method of sampling fluid in a well bore, the method comprising: providing a plurality of sleeve valves in tubing in the well bore, the sleeve valves each having at least one port and an open position that allows fluid access to fluid outside the tubing in the wellbore through the at least one port, and a closed position where fluid access through the at least one port is blocked;

inserting a sampling tool corresponding in size to one of the plurality of sleeve valves into the wellbore until it contacts the sleeve valve and moves the sleeve valve to an open position; the sampling tool having to and bottom sealing elements, the bottom sealing element of the sampling too for sealingly engaging the lower sealing element of a sleeve valve, and the top sealing element for sealingly engaging the upper sealing element of the sleeve valve when the sleeve valve is in the open position, the engagement of the bottom sealing element of the sampling tool and the lower sealing element of the sleeve valve fixing the position of the bottom sealing element relative to the lower sealing element so that the movement of the sampling tool down the well after such engagement moves the sleeve valve from the closed position to the open position;

filling the sampling tool with fluid from the well bore by maintaining the sampling tool in the open sleeve valve;

removing the sampling tool from the sleeve valve, thereby moving the sleeve valve to the closed position; and transporting the fluid out of the well bore by extracting the sampling tool from the well bore.

10. The method of claim 9, further comprising:

arranging the plurality of sleeve valves in the well in descending order based on the size of each sleeve valve, with the sleeve valve having the largest size nearest the top of the well, and that with the smallest size nearest the bottom of the well.

* * * * *